United States Patent [19]

Smoljo

[11] Patent Number: 4,798,220

[45] Date of Patent: Jan. 17, 1989

[54] THERMO BLANKET

[76] Inventor: Dragomir Smoljo, Box 1285, Gravenhurst, Ontario, Canada, POC 1JO

[21] Appl. No.: 870,181

[22] Filed: Jun. 3, 1986

[51] Int. Cl.[4] ..... B62D 63/04; E04B 1/34; E04D 1/34

[52] U.S. Cl. ..... 135/115; 52/3; 52/DIG. 12; 52/63; 135/91; 135/117; 135/900; 160/354; 160/327

[58] Field of Search ..... 52/DIG. 12, 3, 4, 63, 52/406, 407; 135/91, 92, 112, 111, 117, 119, 115, 116, 900; 160/327, 354

[56] References Cited

U.S. PATENT DOCUMENTS

| | | | |
|---|---|---|---|
| 2,363,916 | 11/1944 | Waterman et al. | 135/91 X |
| 3,085,816 | 4/1954 | Nolte | 52/DIG. 12 |
| 3,715,843 | 2/1973 | Ballinger | 52/3 |
| 4,206,575 | 6/1980 | Leonard | 52/3 |
| 4,590,714 | 5/1986 | Walker | 52/3 |
| 4,632,329 | 12/1986 | Burley | 52/3 X |

FOREIGN PATENT DOCUMENTS

| | | | |
|---|---|---|---|
| 2931945 | 2/1981 | Fed. Rep. of Germany | 52/3 |

*Primary Examiner*—David A. Scherbel
*Assistant Examiner*—Richard E. Chilcot, Jr.
*Attorney, Agent, or Firm*—Eugene J. A. Gierczak

[57] ABSTRACT

An insulating flexible panel adapted to be releasably joined to like panels in side by side relationship, said panel comprising enclosure means for enclosing insulating material therein, said enclosure means presenting a first border and a second border, said second border extending generally outwardly of said enclosure, and releasable fastening means associated with said first and second borders adapted to releasably fasten said first border of one panel to said second border of another panel.

16 Claims, 3 Drawing Sheets

THERMO BLANKET

FIELD OF INVENTION

This invention relates to insulating flexible panels, and in particular, relates to insulating flexible panels to be used in association with scaffolding to produce portable erectable insulated structures.

BACKGROUND TO THE INVENTION

Various methods have been used in the past to produce panels having insulating properties, and which panels may be used in the construction of wall assemblies or the like.

For example, U.S. Pat. No. 4,494,384 discloses a panel assembly which includes an insulating core to be used to construct modular building panel assemblies.

Furthermore, U.S. Pat. No. 4,107,892 illustrates a pre-fabricated wall panel unit capable of being matingly jointed with like units in edge-abutting relationship to form a wall.

Moreover, U.S. Pat. No. 4,283,888 teaches a method for heat insulating and protecting the roof structure, such as residential homes and greenhouses, against the action of wind and rain, the exterior of the structure is provided with a covering constituted by interlaced threads of mineral fibers assembled together and preferrably by a knitted fabric of glass fiber threads.

U.S. Pat. No. 4,497,859 is directed to a mobile and collapsible insulating insert for storage and transportation containers where the insert has a hood which has connected outside surfaces made of non-foamed flexible material. The outside surfaces are provided with pockets of non-foamed flexible material projecting into the inside of the hood disposed closely one beside the other and extending over the length of the outside surfaces.

Finally, U.S. Pat. No. 2,196,704 teaches a wind break for oil derricks.

Such structures referred to above have limited utility, particularly when an insulated wall structure is to be temporarily erected, as for example, when workers are bricking a home or other structure in cold or subzero temperatures.

The normal practice for bricking homes in cold or subzero temperatures has been that of attaching polytarps to the roof of a newly constructed home and wrapping same around scaffolding placed adjacent the home. The space between the newly constructed home and polytarp is heated so as to allow the workers to continue bricking the home.

Such polytarp structures, although useful, are inefficient as thermo barriers.

OBJECTS OF THE INVENTION

It is an object of this invention to provide an insulating flexible panel which exhibits improved heat insulating characteristics.

It is another object of this invention to provide an improved portable erectable insulating structure.

FEATURES OF THE INVENTION

One aspect of this invention resides in an insulating flexible panel adapted to be releasably joined to like panels in side by side relationship, said panel comprising an enclosure for enclosing insulating material therein, where such enclosure presents a first border and a second border, where the second border extends generally outwardly of said enclosure, and releasable fastening structure associated with the first and second borders adapted to releasably fasten the first border of one panel to the second border of another panel.

Another aspect of this invention resides in an insulating flexible panel adapted to be releasably joined to like panels in adjacent side by side relationship, each said panel including spaced inner and outer surfaces joined to the side surfaces so as to define an enclosure adapated to receive removable resilent insulating bat material therebetween with each of said side surfaces adapted to engage scaffold means, and where one of said inner or outer surfaces presents a first border and a second border, where the second border extends generally outwardly beyond the side surfaces and adapted to overlap the first border of an adjacent panel, whereby said side surfaces of said panel and said adjacent panel engaged said scaffold means therebetween, and releasable fastening structure associated with the first and second borders and adapted to releasably fasten the first border of one panel to the second border of another panel.

A further aspect of this invention resides in a wall assembly comprising tubular structure; insulating flexible panels where each panel comprises, spaced quadrilateral flexible inner and outer surfaces joined to opposite flexible side surfaces so as to each of said side surfaces adapted to engaged said tubular structure the enclosure including flexible partition walls joined to the inner and outer surfaces so as to define pockets within the enclosure, removable resilient insulating bat material adapted to be removably placed within the pockets of the enclosure, one of the inner or outer surfaces presenting a first border along two sides of one of said quadrilaterial inner or outer surfaces, and presenting a second border extending generally outwardly beyond the enclosure along the other two sides of one of said quadrilateral inner or outer surfaces, and the second border adapted to overlap the first border of adjacent panels; loop pile fastener material associated with the first and second borders; whereby the tubular structure is embraced between the side surfaces of adjacent panels and by the second border of one of said inner or outer surfaces when the loop pile fastener material associated with the first border of one panel is releasably fastened to the loop pile fastener material of the second border of another adjacent panel.

Yet another aspect of this invention resides in a portable erectable insulated structure comprising scaffold structure defining the contour of the structure; insulating panels, each panel comprising, spaced generally square inner and outer polyester surfaces joined to opposite polyester side surfaces so as each of said side surfaces adapated to embrace said scaffold structure the enclosure including partition walls joined to the inner and outer surfaces os as define pockets within the enclosure, removable resilient insulating bat material adapted to be removably placed within the pockets of the enclosure, the inner surface presenting a first loop pile fastener border along two adjacent sides of the square surface, the inner surface presenting a second loop pile fastener border extending outwardly beyond the enclosure along the other two adjacent sides of the outer surface and adapted to overlap the first loop pile fastener boarder; whereby the scaffold members are embraced between side surfaces of adjacent panels and by the second loop pile fastener borders of the inner surface when the first loop pile fastener border of one panel is releasably fastened to the second loop pile fastener border of adjacent panels.

DESCRIPTION OF THE DRAWINGS

These and other objects and features are illustrated and described in the following specification to be read in conjunction with the sheets of drawings in which.

DESCRIPTION OF THE INVENTION

Identical parts have been given identical numbers throughout the figures.

Figure 1:
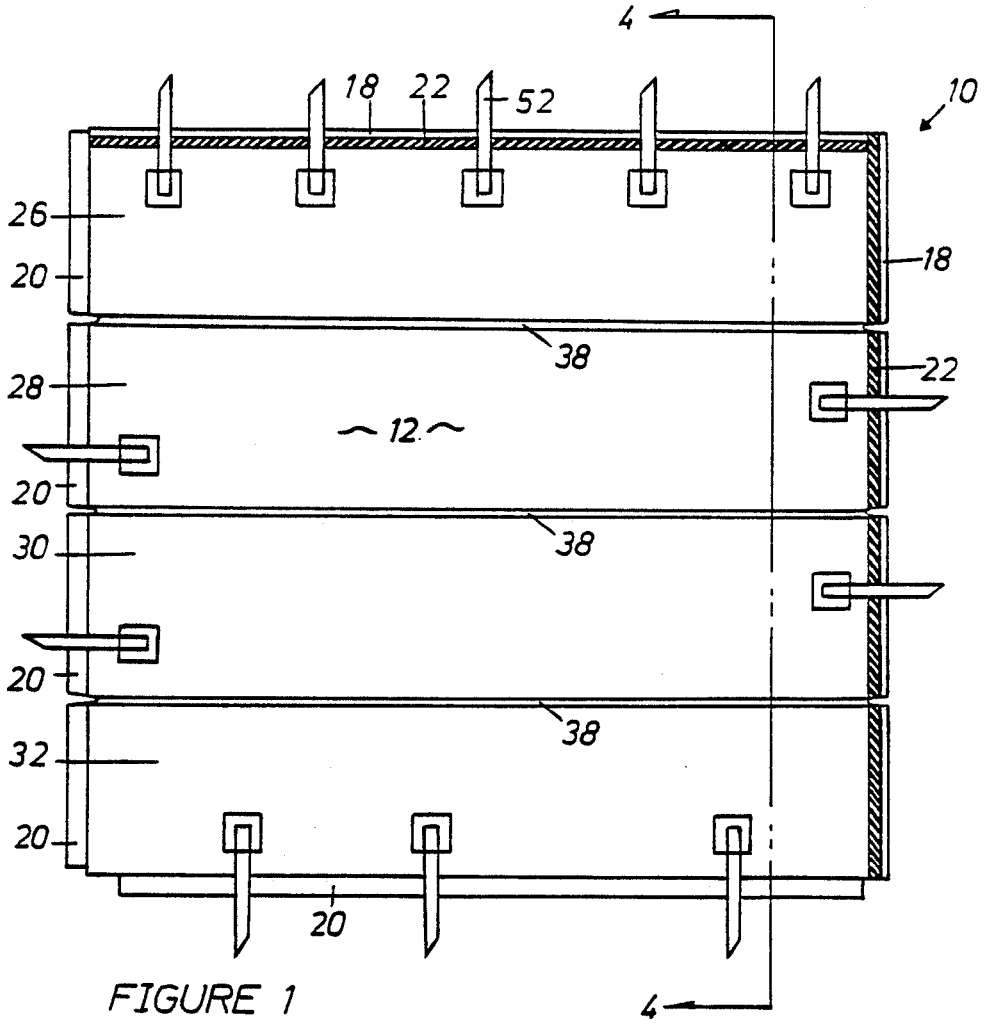
FIG. 1 is a top plan view of said insulating flexible panel.
Figure 2:
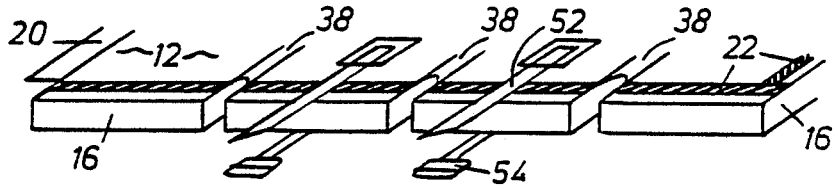
FIG. 2 is a partial perspective side elevational view of said insulating flexible panel.

The insulating flexible panel is generally illustrated as 10 in FIG. 1 and presents an inner surface 12 and outer surface 14, and side surfaces 16 defining an enclosure therebetween.

The inner and outer surfaces 12 and 14 are quadrilateral in shape and in particular are square as illustrated in FIG. 1, although panels 10 may be of any convenient shape provided that the side surfaces 16 of each panel 10 engages with the scaffold members 50 in a manner to be more fully described herein.

The inner surface 12 of the panel 10 presents a first margin or border 18 along the two adjacent side perimetral edges of panel 10, and a second margin or border 20 along the other two adjacent side perimetral edges of panel 10. The second border 20 extends generally outwardly of the side surfaces 16.

The first border 18 presents a male VELCRO (trade mark) loop pile fastener material 22, and the second border 20 presents a female VELCRO (trade mark) loop pile fastener material 24. It is possible that outer surface 14 also presents a first border 18 and a second border 20 with male VELCRO (trade mark) loop pile fastener material 22 and female VELCRO (trademark) loop pile fastener material 24 respectively as illustrated by phantom lines in FIG. 4.

The insulating flexible panel 10 illustrated in FIG. 1 has four box sections 26, 28, 30 and 32, which are joined to one another by heat sealing in a manner to be described herein.

Figure 5:
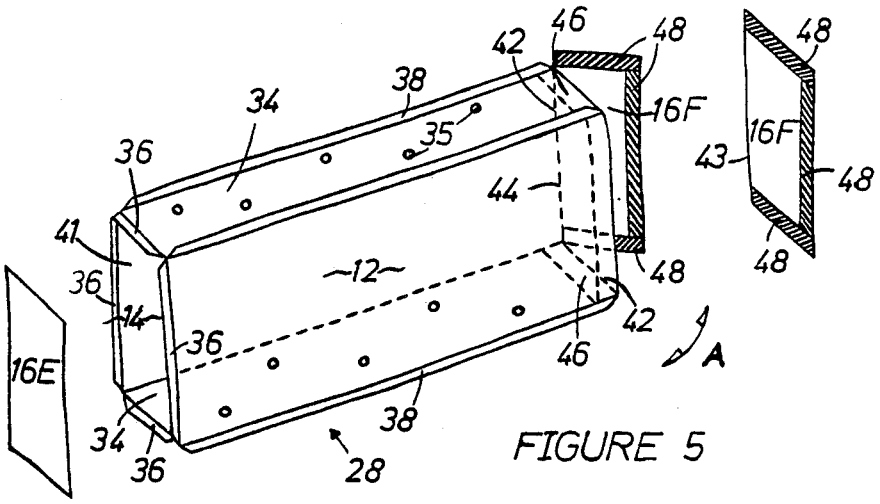
FIG. 5 is a perspective exploded view of a box structure of said panel.

The construction of the box sections 26, 28, 30 and 32 may be described by referring to FIG. 5 which illustrates in more detail box section 28. The other box sections 26, 30 and 32 are constructed in a similar fashion.

Box section 28 comprises generally of a polyester material having an inner surface 12, outer surface 14, and partition walls 34 defining a hollow structure having a rectangular cross-section. Inner surface 12, outer surface 14, and partition walls 34 are made of polyester material such as that identified under the trade mark "VINTEX."

The inner surface 12, outer surface 14, and partition walls 34 of one end of box 28 present sealing edges 36 which are adapted to overlap sides **16*e* as illustrated in FIG. 5** and to be heat sealed thereto in a well known fashion.

The inner and outer surfaces 12 and 14 also present sealing flaps 38 which are adapted to overlap sealing flaps 38 of adjacent boxes 26, 30 and 32 as the case may be and to be heat sealed thereto in a fashion well known to those skilled in the art so as to present the panel 10 illustrated in FIG. 1.

Each box 26, 28, 30 and 32 is adapted to receive a bat of insulating material 40 within the pocket 41 formed by inner surface 12, outer surface 14, side surface 16 and partition walls 34.

The inner surface 12, of the other end of box 28, presents sealing edge 42 which is adapted to be heat sealed to one edge 43 of side **16*f* to present a hinge joint 44 so that side 16*f*** may rotate in the direction of arrow A.

The outer surface 14 and partition walls 34 of the other end of box 28 also presents sealing edges 46 which are adapted to engage with corresponding edges 48 of side **16*f*. The sealing edges 46 may either be heat sealed to corresponding edges 48 of side 16*f* once the insulation 40 is inserted into the pockets 41 referred to earlier; or the sealing edges 46 may contain a strip of male VELCRO (trade mark) loop pile fastener material which is adapted to releasably engage with female VELCRO (trade mark) loop pile fastener material presented by corresponding edges 48. Such releasable sealing structure permits the easy withdrawal of damaged or used insulating material 40 and the insertion of new insulating 40 so as to replace same. In particular side 16*f* presents a flap which permits the insulating bat material 40 to be freely moveable into the enclosure when the flap is in the open position. The insulating bat material 40 fills the enclosure and is not stitched to the surfaces 12, 14, 16, nor partitioning walls 34 when the flap 16** is in the closed position.

Figure 4:
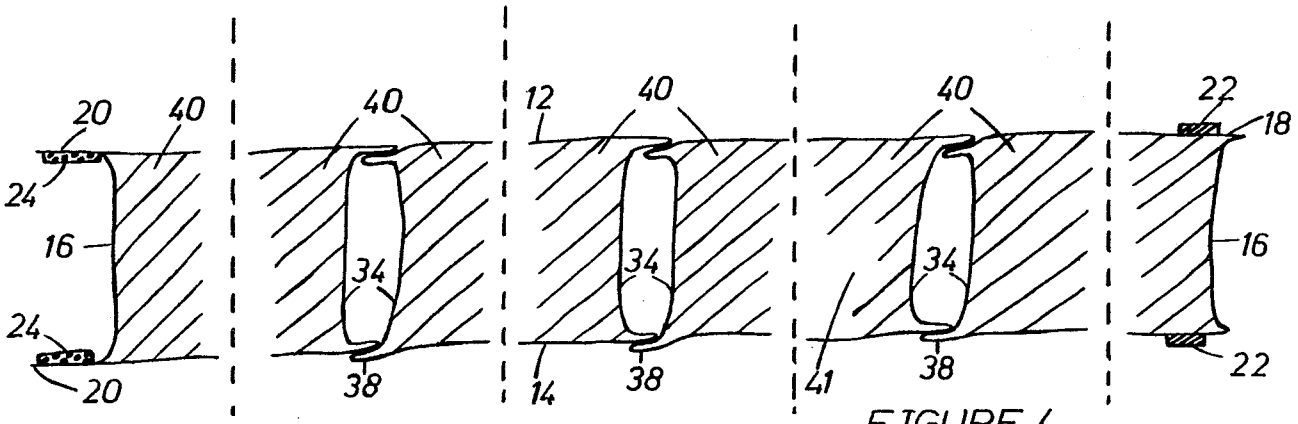
FIG. 4 is a cross-sectional view taken along the lines 4—4 of FIG. 1.
Figure 3:
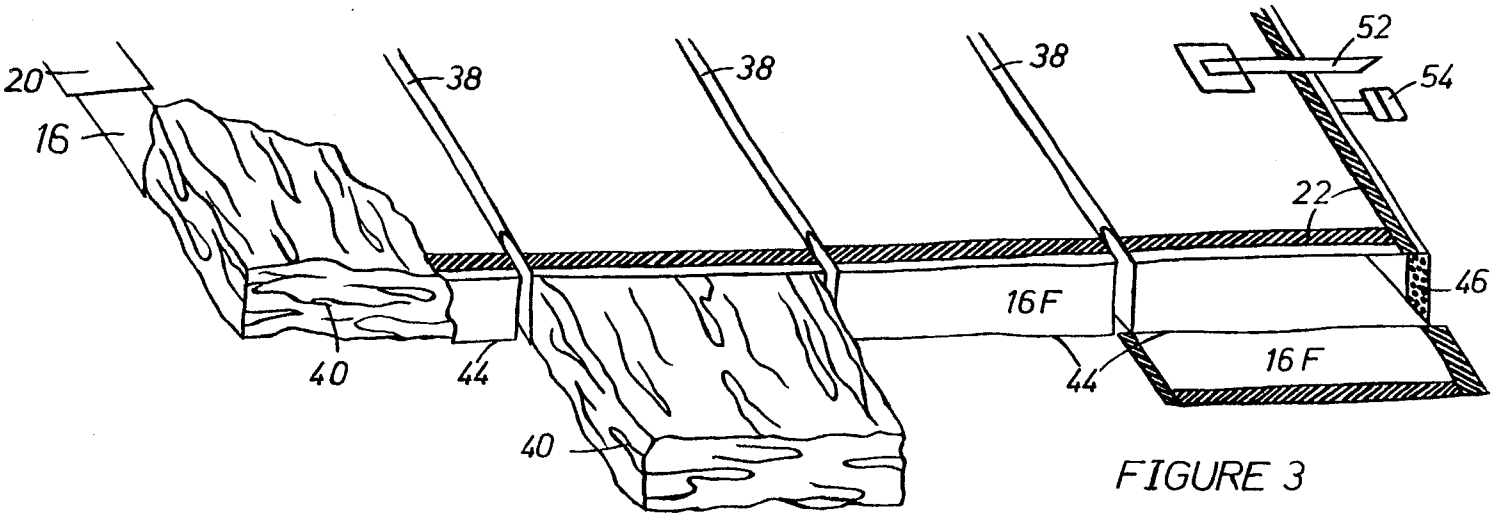
FIG. 3 is a partial perspective side elevational view of said insulating flexible panels illustrating the removable feature of the insulating material.

FIG. 4 illustrates in greater detail the relationship of the insulating material 40 with inner surface 12, outer surface 14, side 16 and partition walls 34 which define pockets 41.

Figure 6:
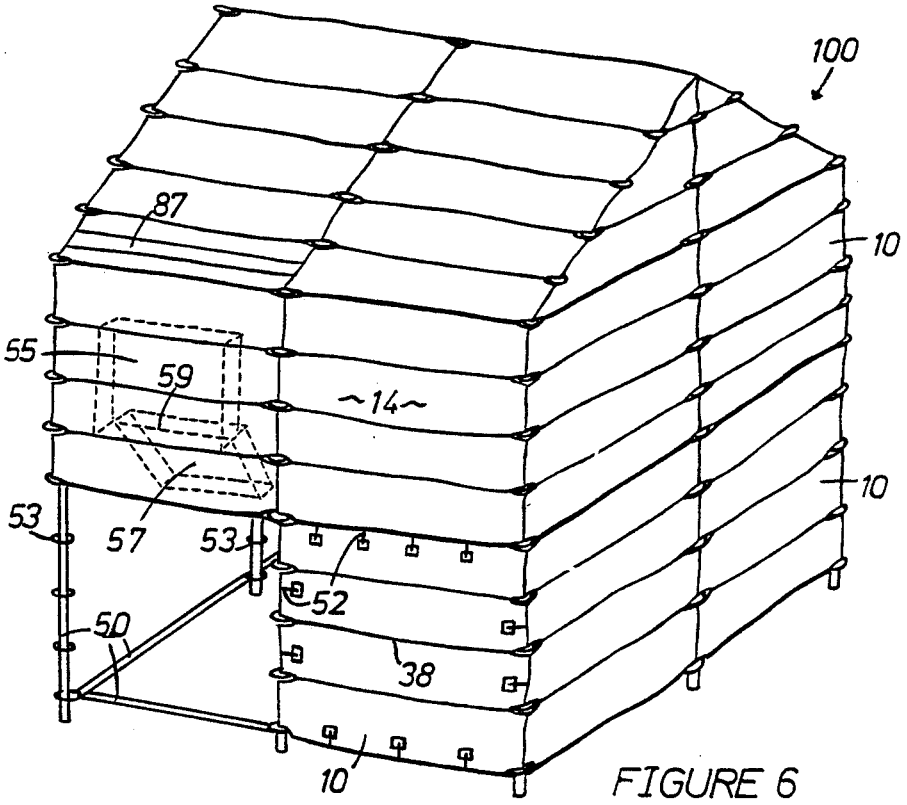
FIG. 6 is a perspective view of a portable erectable insulated structure showing the scaffolds and insulating flexible panels.

The insulating flexible panels 10 are adapted to engage scaffold members 50 in a manner to be described herein by referring to FIG. 6.

The scaffold members 50 are arranged so as to define a particular desired structure 100. The insulating flexible panels 10 are designed so that the sides 16 engage the scaffold 50. The insulating flexible panel 10 includes a series of straps 52 which are located adjacent the borders 18 and 20 and which include buckles 54 which are adapted to wrap around the scaffold members 50 so as to secure the insulating flexible panel 10 thereto. It is usually preferrable to cut the second border 20 in the vicinity of strap 52 so that the second borders 20 may be manipulated without interferring with the straps 52.

The insulating flexible panels 10 are adapted to be joined to one another in side by side relationship so as to embrace the scaffold member 50 therebetween. More particularly, each adjacent insulating flexible panel 10 is strapped to the scaffold member 50 as described and the second border 20 of one panel 10 is adapted to overlie and to be releasably secured to the first border 18 of adjacent panel 10 by the VELCRO (trade mark) loop pile fastener material 24 and 22 in a manner so that the scaffold member 50 is embraced between adjacent sides 16 of panels 10 and embraced by second border 20. Once the second border 20 of one panel 10 is releasably secured to the first border 18 of an adjacent panel 10, a very efficient heat insulating seal is produced.

It has been found that a portable erectable insulated structure 100 may be easily assembled by assembling the scaffold members 50 to define a contour of the desired structure and thereafter to insert the panels 10 between the scaffold members 50 in a manner as described above.

It is possible that both inner surface 12 and outer surface 14 may present first and second borders 18 and 20 respectively so as to improve the heat sealing characteristics of the joined panels 10. However, because scaffold platforms (not shown) are usually assembled interiorally of the structure 100 by attachment to the scaffold rosettes 53 in a manner well known to those persons in the art, it has been found that if a tall portable insulated structure 100 is to be assembled, it becomes easier to assemble such structure if only the inner wall 12 of panel 10 includes first and second borders 18 and 20. In other words, a person may stand on the scaffold platform (not shown) and easily releaseably secure adjacent panels 10 at elevated positions. If outer surface 14 also presents first and second borders 18 and 20 respectively, it will be necessary to use a ladder or the like to releaseably secure adjacent panels 10 at elevated positions.

The portable erectable insulated structures 100 described herein may be utilized in the construction industry, and particularly when bricking newly constructed homes in cold or subzero temperatures. For example, the portable erectable insulated structure 100 disclosed in FIG. 6 may be assembled so that the scaffold member 50 are constructed over an entire home. Thereafter, the insulating flexible panels 10 are inserted between the scaffold members 50 as described above. Such a portable erectable insulated structure 100 may then be heated by conventional means so as to produce a comfortable environment between the structure 100 and the newly constructed home located therein so as to allow workers to work comfortably in bricking a home or the like.

It has been found that the portable erectable insulated structure 100 may produce cost savings in heating the inside of structure 100 as compared to that of wrapping the structure 100 with polytarps in the conventional manner. In particular, tests have been conducted where two identical structures 100 where produced, one of which was covered with the insulating flexible panels 10 described herein and the other of which was covered with a 6 millimeter polytarpaulin. Both floors of the identical structures 100 where insulated with R-24. The site was assembled on ice with open area exposure. Heating for the structure 100 was thermostatically controlled with a 3000 watt heater in the structure 100 covered by panels 10 and with a 9000 watt heater in the structure 100 covered by polytarp. The temperatures and kilowatt hour readings were recorded every six hours, and it was discovered that the structure 100 which was covered by panels 10 was 87.7 percent efficient over the structure 100 covered by polytarp.

The test was based on a 21'×14'×8.6' high structure with a 45 degree roof design, which structure had a 3822 cubic foot capacity with an 80 degree Fahrenheit temperature change.

The following results were observed:

| | PANEL 10 ENCLOSURE | CONVENTIONAL TARP ENCLOSURE | HEAT REDUCTION DUE TO PANEL 10 |
|---|---|---|---|
| Conduction Losses | 0.0509 KW/K (96.5 BTU/hr °F.) | 0.6665 KW/K (1263 BTU/hr °F.) | 92.4% |
| Infiltration Losses | 0.0981 KW/K (185.9 BTU/hr °F.) | 0.5405 KW/K (1024 BTU/hr °F.) | 81.8% |
| Total Heat Losses | 0.1490 KW/K (282.4 BTU/hr °F.) | 1.2070 KW/K (2287 BTU/hr °F.) | 87.7% Average Savings |

Accordingly, costs savings may be realized by using the invention described herein.

Some of the panels 10 may include window assembly 55 illustrated by phantom lines in FIG. 6 so as to allow sunlight into the structure 100. The window assembly would include a transparent plastic material on the outer surface 14 and an insulated window panel 57, which includes an insulation material enclosed in plastic, which is swingable about hinge 59. When the insulated window panel 57 is in the lower position illustrated in FIG. 10, sunlight will enter the structure 100. The insulated windown panel 57 may be closed by swinging the insulated window panel 57 in the direction of arrow D. The edges of insulated windown panel 57 and the corresponding edges of panel 10 may present VELCRO (trade mark) loop pile fastener material so as to releaseably secure the window panel 47 to the panel 10 in a closed position.

When the panels 10 are used as a roof section, such panels 10 may include horizontal straps 87 along the entire width of the panels 10 so as to minimize the tendency of the panels 10 from sagging between the scaffold members 50.

Once the bricking has been completed, the structure 100 may be dismantled by pulling second border 20 away from first border 18 and disengaging the VELCRO (trade mark) loop pile fastener material 24 from 22 of the adjacent panels 10, unstrapping straps 52 and dismantling the scaffold 50. It should be noted that partition walls 34 are provided with a series of holes 35 so that the panels 10 may be compressed for transportation. Once the compression force is removed, the panels 10 assume their expanded state. Thereafter, the scaffold members 50 and insulating panels 10 may be located to a different site.

It should be noted that the portable erectable insulated structures may also be used in the Artic as semi-permanent homes.

Furthermore, this invention should not be limited to only producing portable erectable insulated structures as the invention may also be utilized to construct wall assemblies for oil derricks or the like.

In the preferred embodiment, the inner surface 12, outer surface 14, side surfaces 16 and partition walls 34 are comprised of 18 ounce P.V.C. Vintex over polyester sarim backing having a tensile strength of 200×190 pounds, a trapazoid tear of 80×50 pounds and a flame resistant of Method U.L. 214-PASS. The insulation 40 utilized was that of a pink flexible type having an R factor of R-12 with moisture absorption of less than 2 percent by volume-86 hours at 120 degrees Fahrenheit and 95 percent R.H.

Although the preferred embodiments, as well as the operation and use have been specifically described in relation to the drawings, it should be understood that variations in the preferred embodiments could easily be achieved by a skilled man in the trade without departing from the spirit of the invention. Accordingly, the invention should not be understood to be limited to the exact form revealed in the drawings.

The embodiments of the invention in which an exclusive property or privilege is claimed are defined as follows:

1. An insulating flexible panel capable of being releasably joined to like panels in adjacent side by side relationship for use with scaffold means, each said panel including spaced inner and outer surfaces joined to side surfaces so as to define an enclosure, one of said side surfaces including flap means, insulating bat material freely moveable into and out of said enclosure when said flap means is in an open position, and wherein said insulating bat material fills said enclosure and is not stitched to said surfaces when said flap means is in a closed position, one of said inner or outer surfaces presenting a first border and a second border, said second border extending generally outwardly beyond said side surfaces so as to overlap the first border of an adjacent panel, whereby said side surfaces of said panel and said adjacent panel engage said scaffold means therebetween and releasable fastening means associated with said first and second border for releasably fastening said first border of one panel to said second border of another panel.

2. An insulating flexible panel as claimed in claim 1 wherein said releasable fastening means comprises loop pile fastener means.

3. An insulating flexible panel as claimed in claim 2 wherein both said inner and outer surfaces present first and second borders.

4. An insulating flexible panel as claimed in claim 3 wherein said inner and outer surfaces include strap means to strap said panels to said scaffold means.

5. An insulating flexible panel as claimed in claim 4 wherein one of said flexible side surfaces is hingedly joined to one of said inner or outer surfaces, and is adapted to be releasably joined to said other one of said inner or outer surfaces, so as to permit sadi one of said side surfaces to swing from an open position to permit said bat material to be slidingly placed or removed from said pockets, to a closed position to retain said bat material in said pockets.

6. In a wall assembly comprising:

(a) tubular means, and (b) insulating flexible panels, each panel comprising:

(i) spaced quadrilateral inner and outer surfaces jointed to opposite flexible side surfaces so as to define an enclosure, one of said side surfaces presenting flap means;

(ii) each of said side surfaces engaging said tubular means;

(iii) said enclosure including flexible partition walls joined to said inner and outer surfaces so as to define pockets within said enclosure;

(iv) insulating bat material freely moveable into and out of said pockets when said flap means is in an open position, and wherein said insulating bat material fills said enclosure and is not stitched to said surfaces nor said partition walls when said flap means is in a closed position;

(v) one of said inner or outer surfaces presenting a first border along two sides of one of said quadrilateral inner or outer surfaces, and presenting a second border extending generally outwardly beyond said enclosure along the other two sides of one of said quadrilateral inner or outer surfaces, said second border adapted to overlap said first border of adjacent panels;

(vi) loop pile fastener means associated with said first and second borders whereby said tubular means is embraced between said side surfaces of adjacent panels and by said second border of one of said inner or outer surfaces when said loop pile fastener means associated with said first border of one panel is releasably fastened to said loop pile fastener means of said second border of said adjacent panel.

7. In a wall assembly as claimed in claim 6 wherein said surfaces are comprised of polyester.

8. In a wall assembly as claimed in claim 7 wherein said inner and outer surfaces include strap means adjacent said borders so as to releasably secure said panels to said tubular means.

9. In a wall assembly as claimed in claim 8 wherein said inner surface includes said first and second borders.

10. In a wall assembly as claimed in claim 9 wherein said outer surface also includes said first and second borders.

11. In a wall assembly as claimed in claim 10 wherein said first and second borders are disposed along two adjacent sides respectively of said quadrilateral surfaces.

12. In a portable erectable insulated structure comprising:

(a) scaffold means defining the contour of said structure;

(b) insulating panels, each panel comprising;

(i) spaced generally square inner and outer polyester surfaces joined to polyester side surfaces so as to define an enclosure, one of said side surfaces presenting flap means;

(ii) each of said side surfaces engaging said scaffold means;

(iii) said enclosure including partition walls joined to said inner and outer surfaces so as to define pockets within said enclosure;

(iv) insulating bat material freely moveable into and out of said pockets when said flap means is in an open position, and wherein said insulating bat material fills said enclosure and is not stitched to said surfaces nor said partition walls when said flap means is in a closed position;

(v) said inner surface presenting a first loop pile fastener border along two adjacent sides of said generally square inner surface;

(vi) said inner surface presenting a second loop pile fastener border extending generally outwardly beyond said enclosure along the other two adjacent sides of said inner surface and adapted to overlap said first loop pile fastener border of an adjacent panel;

whereby said scaffold means are embraced between said side surfaces of adjacent panels and by said second loop pile fastener borders of said inner surface when said first loop pile fastener border of one panel is releasably fastened to said second loop pile fastener border of said adjacent panel.

13. In a portable rectangular insulated structure as claimed in claim 12 wherein said outer surface includes:

(a) a first loop pile fastener border along two adjacent sides of said generally square outer surface, and (b) a second loop pile fastener border extending generally outwardly beyond said enclosure along the other two adjacent sides of said outer surface and adapted to overlap said first loop pile fastener border of another panel whereby said scaffold means are embraced by said side surfaces of adjacent panels and by said second loop pile fastener borders of said outer and inner surfaces when said first loop pile fastener border of one panel is releasable fastened to said second loop pile fastener borders of said adjacent panel.

14. In a portable generally square insulated structure as claimed in claim 13 wherein said first and second loop pile fastener border of said inner and outer surfaces are disposed opposite one another respectively.

15. In a portable generally square insulated structure as claimed in claim 14 where said insulating panels include window means.

16. In a portable square insulated structure as claimed in claim 14 wherein said partition walls include holes.

* * * * *